United States Patent [19]

Sartor

[11] Patent Number: 4,748,751

[45] Date of Patent: Jun. 7, 1988

[54] SKI BOOT WITH A FOOT SECURING DEVICE

[75] Inventor: Mariano Sartor, Montebelluna, Italy

[73] Assignee: Nordica S.p.A., Montebelluna TV, Italy

[21] Appl. No.: 936,865

[22] Filed: Dec. 1, 1986

[30] Foreign Application Priority Data

Dec. 24, 1985 [IT] Italy ..... 23382 A/85

[51] Int. Cl.[4] ..... A43B 5/04

[52] U.S. Cl. ..... 36/119; 36/50

[58] Field of Search ..... 36/117–121, 36/50

[56] References Cited

U.S. PATENT DOCUMENTS

| | | | |
|---|---|---|---|
| 4,196,530 | 4/1980 | Delery | 36/119 |
| 4,449,274 | 5/1984 | Balbinot | 36/117 X |
| 4,620,379 | 11/1986 | Sartor | 36/119 |

FOREIGN PATENT DOCUMENTS

| | | | |
|---|---|---|---|
| 0134778 | 3/1985 | European Pat. Off. | 36/119 |
| 0166213 | 1/1986 | European Pat. Off. | 36/117 |
| 0169190 | 1/1986 | European Pat. Off. | 36/119 |
| 0188818 | 7/1986 | European Pat. Off. | 36/119 |
| 2564711 | 11/1985 | France | 36/119 |

*Primary Examiner*—James Kee Chi

*Attorney, Agent, or Firm*—Guido Modiano; Albert Josif

[57] ABSTRACT

The ski boot with a foot securing device comprises a shell to which at least one quarter is associated. The device comprises at least one securing tension element which extends, at least partially, within the shell and is connected to traction members adapted for varying the useful length of the tension element inside the shell, and being activatable by the oscillation of the quarter with respect to the shell and provided with a locking apparatus for the operative uncoupling of the lever from the oscillation of the quarter. Removable locking members are furthermore provided for slackening the tension element.

22 Claims, 2 Drawing Sheets

1
2
3
4
5
6
10
11
12
15
15a
20
21
22
24
25
25a
26
27
30
31
32
32a
34
35
100

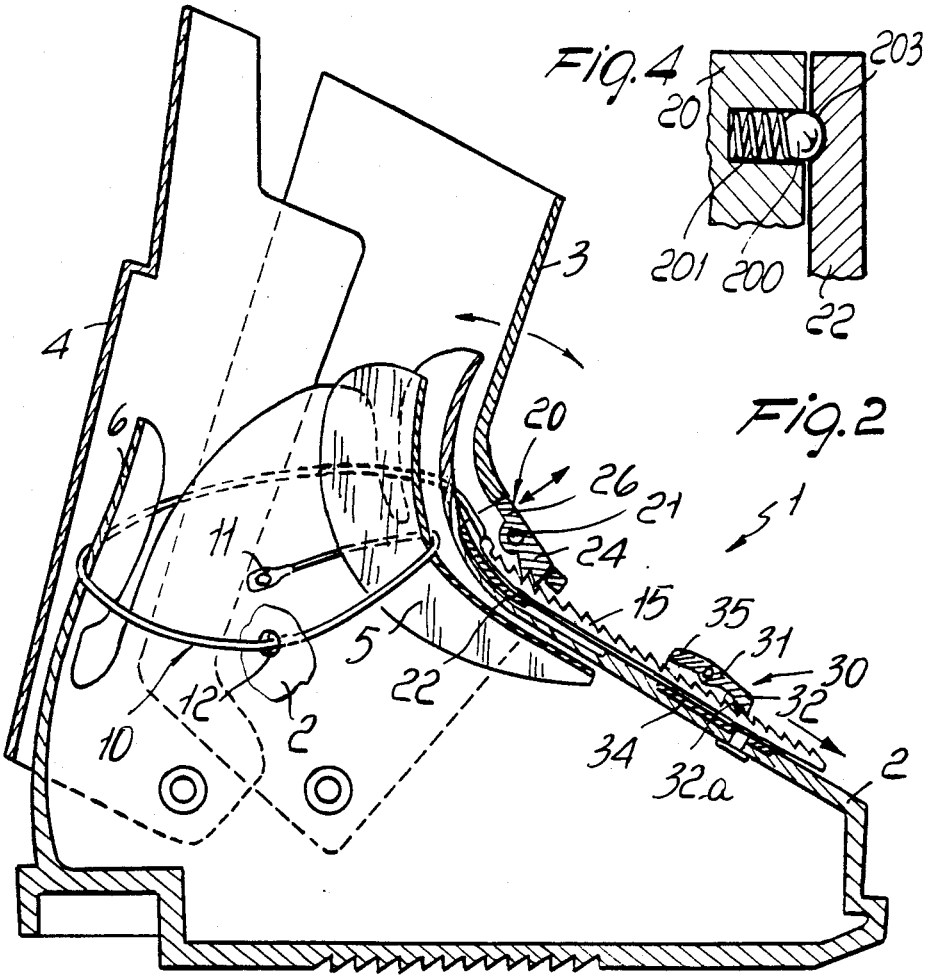
Fig.4
203
20
201
200
22
Fig.2
3
4
6
20
26
21
24
1
11
15
35
31
30
32
5
22
12
2
10
34
32a
2
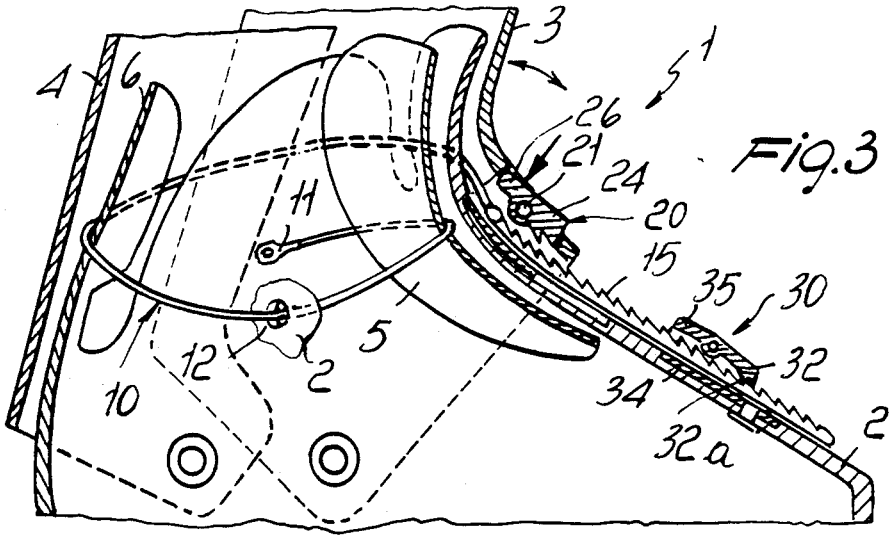
Fig.3
3
1
4
6
26
21
24
20
11
15
35
30
32
5
12
2
10
34
32a
2

SKI BOOT WITH A FOOT SECURING DEVICE

BACKGROUND OF THE INVENTION

The present invention relates to a ski boot with a foot securing device.

As is known, in ski boots, and particularly in rear-entry ski boots, devices are currently employed which perform the securing of the foot.

These devices, in their most common embodiments, have a foot instep presser over which a cable or other flexible element extends transversely and is operated from the outside of the boot to press the presser against the foot instep.

Other solutions illustrated in prior patent applications of the same applicant entail the use of a cable which, besides extending above the foot instep presser, also performs the rearward securing of the heel, so as to safely secure the foot inside the shell.

In all the known solutions, it occurs that the actuation of the cable, to vary its useful length, is achieved by means of levers, which are accessible from the outside of the boot or possibly by means of spools or similar elements which perform the winding of the cable until the required securing force is obtained.

Essentially, all the known solutions entail the need for an actuation to be performed by hand, to obtain the securing of the foot inside the boot.

This fact gives rise to some difficulties for the users, taking also into account the evironmental conditions in which this maneuver is usually performed, due to the fact that it is not always possible to exert the desired securing force by hand, and furthermore the devices intended to operate the securing assembly are not always easily accessible by the user.

SUMMARY OF THE INVENTION

The aim proposed by the invention is indeed to eliminate the above described disadvantages by providing a ski boot with a foot securing device which can be operated without having to perform the locking action by the hand, thus simplifying all the operations related to the precise securing of the foot inside the boot.

Within the scope of the above described aim, a particular object of the invention is to provide a ski boot which allows the possibility of obtaining even high securing forces for the foot, without thereby requiring the manual exertion of efforts in any way excessive or troublesome for the user.

Still another object of the present invention is to provide a ski boot wherein the securing device does not entail the presence of operating devices which protrude excessively from the boot.

A not least object of the present invention is to provide a ski boot with a foot securing device which, by virtue of its peculiar structural characteristics, is capable of giving the greatest possible assurances of reliability and safety in use.

The above described aim, as well as the objects referred to and others which will become apparent hereinafter, are achieved by a ski boot with a foot securing device, according to the invention, comprising a shell, wherewith is associated at least one quarter, characterized in that it comprises a tension element, adapted for securing the foot inside said shell and being connected to traction means, adapted for varying the useful length of said tension element inside said shell, and for being activated by the oscillation of said at least one quarter with respect to said shell and being provided with a locking element, adapted for effecting operative uncoupling of said traction means from the oscillation of said at least one quarter, locking means there being furthermore provided which are removable for slackening said tension element.

BRIEF DESCRIPTION OF THE DRAWINGS

Further characteristics and advantages will become apparent from the description of a preferred, but not exclusive, embodiment of a ski boot with a foot securing device, illustrated, by way of example only, in the accompanying drawings, wherein:

FIG. 2 is a schematic cross section view of the ski boot during the operation of the securing device; and, FIG. 3 is a view of the ski boot positioned for skiing.

FIG. 4 is a fragmentary transverse sectional view, to an enlarged scale, of a detail of the traction means.

DESCRIPTION OF THE PREFERRED EMBODIMENTS

Figure 1:
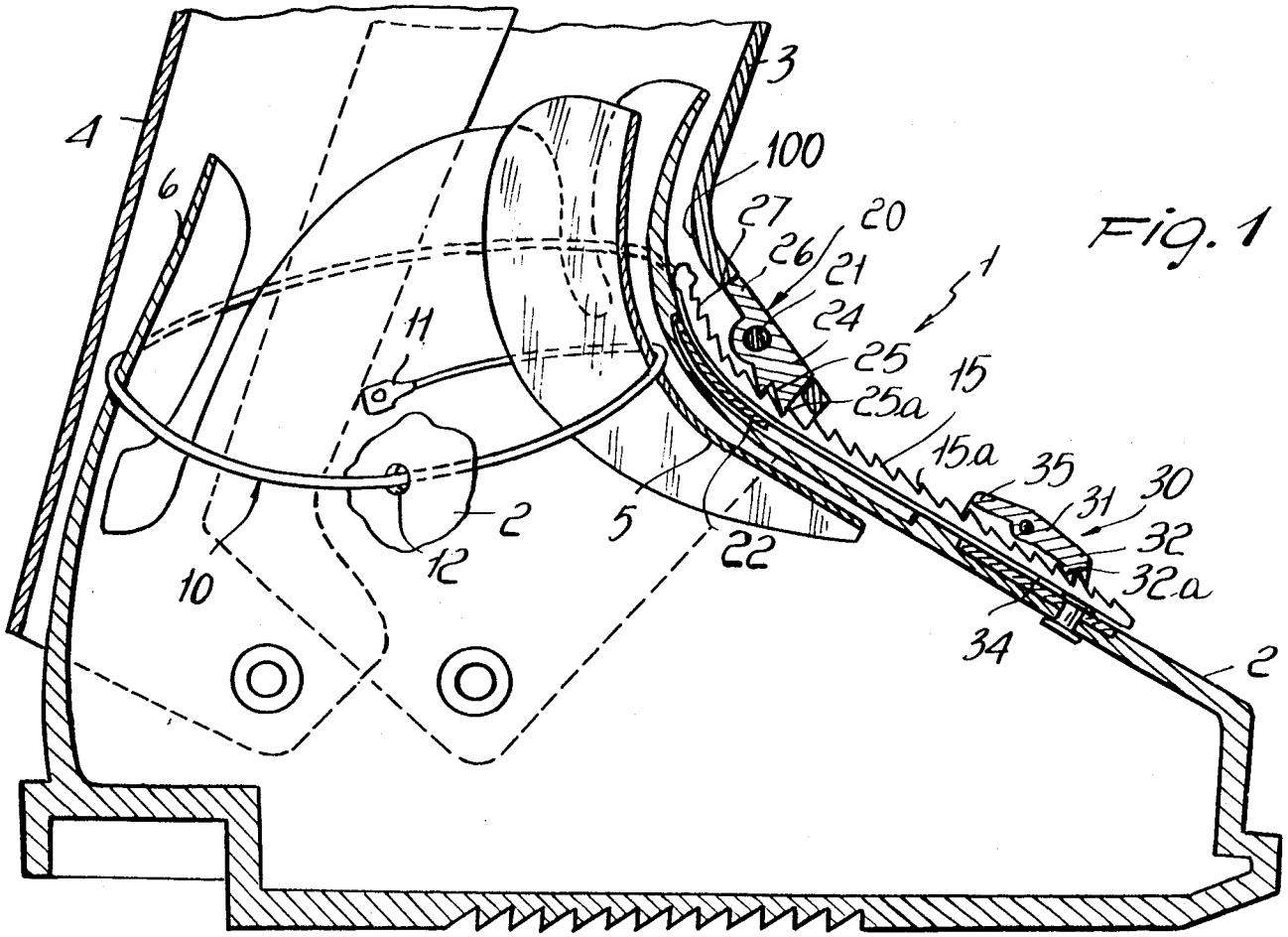
FIG. 1 is a longitudinal cross section view of the ski boot according to the invention.

With reference to the above described figures, the ski boot with a foot securing device, generally indicated by the reference numeral 1, comprises a shell 2 to which a front quarter 3 and a rear quarter 4, per se of a known kind, are pivotably coupled.

The base 2 has, in its interior, as will be better described hereinafter, a foot instep presser 5 and a rear tab 6 for securing the heel.

The peculiarity of the invention resides in the fact that a foot securing tension element is provided, composed, e.g., of a cable 10, which can be made of a metal strand, of a flexible strip or of other elements having a similar functionality.

Said cable 10 has its end fixedly coupled to a point 11, on an internal lateral portion of the shell.

The cable 10 extends transversely above the foot instep presser 5 and passes in a first hole 12 to exit from the shell; then the cable 10 extends rearwardly with respect to the tab 6, outside the shell.

The cable 10 is connected, outside the shell, to a toothed or notched strip 15 which extends, as will be better described hereinafter, in the front part of the shell.

With the toothed strip 15 engage traction means for varying the useful length of the cable inside the shell 2 which are supported by the front quarter 3 and which, advantageously, are composed of a lever 20 pivoted at its middle portion 21 to a small base 22 fixed to the front quarter 3, which defines the passage region for the toothed strip 15.

The lever 20 has an engagement end 24 with saw-like teeth 25 which have an abutment protrusion **25*a* directed towards the front part of the boot and facing the abutment protrusion 15*a* of the teeth of the toothed strip 15, which has said abutment protrusion 15*a*** directed towards the rear part of the boot.

Elastic means 100 act on the lever 20, which means are composed of a pin-spring or of similar elements, which keep the same lever elastically engaged against the toothed strip 15, so that a coupling between the protrusion **15*a* and the protrusion 25*a*** is achieved for extracting the cable from the base.

At the other end of the lever 20 an operating tab 26 is provided, which can be engaged, against the elastic biasing action of said pin-spring, with a locking protrusion 27 defined by the quarter 3 and which is intended to disable, as will be better described hereinafter, the lever 20, by uncoupling its teeth 25 from the toothed strip 15, while skiing.

To disable the lever 20, other means can be employed, such as, e.g., a ball 200 accommodated laterally to the lever itself and pushed by a spring 201 to snap into recesses 203 defined on the sides of the small base 22.

The important peculiarity of the invention is that said traction means for varying the useful length of the cable inside the shell can be activated by the oscillation of the front quarter with respect to the base 3, and in particular it occurs that during the forward oscillation an active coupling is performed between the teeth 25 and the toothed strip 15, with the consequent motion of the srip itself in the direction of extraction of the cable from the base, with the consequent securing of the foot, achieved by the combined action of the presser 5 and of the rear tab 6 which acts on the heel.

In the rearward oscillation of the quarter, a ratchet-like return of the lever 20 occurs with respect to the toothed strip 15, so that a subsequent forward oscillation of the quarter gives rise to a further extraction of the cable, with a consequent tighter securing of the foot.

On the boot, a releasable locking device is furthermore provided, for slackening the cable, which is composed of a small block 30 fixed to the shell, and composed of a locking lever 31, pivoted in a middle portion thereof to the fixed small base 34 fixed to the shell; the lever 31 has a toothed active end 32 with saw-like teeth provided with an abutment protrusion **32*a*** directed forwards so as to engage with the teeth of the toothed strip to prevent the slackening of the cable, i.e. a motion of the toothed strip in the direction of reentry of the cable into the shell.

The lever 31 is furthermore provided with an operating end, indicated by the reference numeral 35, which overcomes the biasing action of the spring, which elastically keeps in contact the teeth 32 with the strip 15, to perform, when desired, the slackening of the cable.

The lever 31, can also be provided with disabling means similar to those employed for the lever 20.

In practical use, it occurs that the user, after having put the boot on, can perform an alternate oscillation of the quarter, thus giving rise to the variation of the useful length of the cable inside the shell, and in particular, as previously described, to the extraction of the cable from the shell, with the consequent tightening of the presser 5 and of the rear tab 6 on the foot, until the desired securing force is achieved.

As already previously mentioned, the active stroke is composed by the forward oscillation of the quarter, while in the rearward oscillation of the quarter the teeth 25 skip on the toothed strip which is retained due to the presence of the front block 30, which prvents its free sliding in the direction of reentry of the cable into the shell.

Once the desired foot securing action is achieved, one acts on the operating tab 26 of the lever 4 so as to engage it with the locking element provided by the quarter, so as to uncouple the lever 20 from the toothed strip, so that further oscillations of the quarter, which occur during normal skiing, no longer act on the adjustment of the foot securing device.

To perform the slackening of the cable, it is sufficient to act on the end 35 of the front block 30, uncoupling the teeth 32 from the teeth 15 of the toothed strip, which can thus slide freely, allowing the reentry of the cable into the shell, with the consequent loosening of the securing action performed.

From what has been described, it is apparent that the device achieves the intended aim, and in particular the fact is stressed that the described arrangement allows the securing of the foot without having to use the hand, as occurs in conventional boots, but by employing the oscillation of the front quarter as a ratchet.

Furthermore, the length of the front quarter allows the exertion of even high foot securing actions without thereby giving rise to significant efforts on the part of the user.

Furthermore, it is extremely important that during normal skiing the traction means of the cable are easily and quickly uncoupled by simply achieving the uncoupling of the saw-like teeth 25 of the lever 20 from the toothed strip 15.

The invention thus conceived is susceptible of numerous modifications and variations, all of which are within the scope of the inventive concept.

Furthermore, all the details can be replaced by other technically equivalent elements.

In practice, the materials employed, as well as the dimensions and contingent shapes, may be any according to the requirements.

I claim:

1. In combination, a ski boot and a foot securing device, said ski boot comprising at least one quarter and a shell having a front portion, an inside and a lateral internal surface, said device comprising at least one tension element, traction means, at least one fixed point, at least one presser, at least one first hole, at least one rear tab, said quarter being associated with said shell, said tension element being adapted for securing a skier's foot inside said shell and connected to said traction means, said quarter being adapted for oscillation with respect to said shell, said traction means being activated by said oscillation of said quarter with respect to said shell and having at least one locking element, said locking element being adapted for effecting operative uncoupling of said traction means from said oscillation of said quarter with respect to said shell, said foot securing device further comprising means for releasably locking said tension element, said fixed point being located at said lateral internal surface of said shell, said presser being arranged at said inside of said shell, said first hole being formed laterally on said shell, said tab being defined rearwardly by said shell, said tension element being attached to said fixed point, extending substantially transversely above said presser, protruding from said shell at said first hole, and rearwardly engaging said tab, said tension element having a toothed strip, said toothed strip being located externally of said shell, and slidably positioned on said front portion thereof.

2. Combination according to claim 1, wherein said boot defines a rear part, wherein said at least one toothed strip defines first abutment protrusions, and wherein said traction means comprise, at least one base, saw-like teeth having at least one second abutment protrusion, elastic means, and at least one lever having a middle portion and at least one engagement end, said lever being pivotally coupled at said middle portion thereof to said base, said base being fixed to said at least one quarter, said saw-like teeth being provided at said engagement end of said lever, said second abutment protrusion of said saw-like teeth being directed towards said front portion of said shell and opposed to at least one of said first abutment protrusions of said at least one toothed strip, said first abutment protrusions of said at least one toothed strip being directed towards said rear part of said boot, said elastic means being adapted for causing said saw-like teeth of said engagement end of said lever to engage with said at least one toothed strip.

3. A combination according to claim 2, wherein said locking element comprises at least one operating tab, said operating tab being defined by said lever, said lever having an opposite side with respect to said engagement end, said operating tab being defined by said opposite side of said lever with respect to said engagement end, said at least one quarter having defined thereon at least one locking protrusion, said locking element being operable for uncoupling said traction means from said oscillation of said at least one quarter with respect to said shell, said operating tab being engageable with said locking protrusion defined on said at least one quarter.

4. Combination according to claim 2, wherein said locking element comprises at least one elastically pushed ball, and wherein said base has formed thereon a plurality of recesses, said at least one elastically pushed ball being at least partially laterally accommodated in said lever, said elastically pushed ball being at least partially insertable in at least one of said recesses, said locking element being operable for uncoupling said traction means from said oscillation of said at least one quarter with respect to said shell.

5. Combination according to claim 2, wherein said base fixed to said at least one quarter and said lever pivotally coupled at said middle portion thereof to said base define in combination, at least one sliding zone of said toothed strip.

6. Combination according to claim 1, wherein said means for releasably locking said tensioning element comprises at least one block, at least one locking lever having a middle portion and at least one locking end, elastic biasing means, at least one locking abutment protrusion, and locking teeth, said block being fixed to said front portion of said shell, said middle portion of said locking lever being pivotally connected to said block, said locking teeth and said at least one locking abutment protrusion being defined at said locking end of said locking lever, said locking teeth having a saw-like teeth configuration, said locking abutment protrusion being directed towards said front portion of said shell, said elastic biasing means being adapted for biasing said locking end of said locking lever into engagement with said toothed strip.

7. In combination, a ski boot and a foot securing device, said ski boot comprising at least one quarter and a shell having a front portion, an inside and a lateral internal surface, said device comprising at least one tension element, traction means, and at least one presser, said quarter being associated with said shell, said tension element being adapted for cooperation with said at least one presser for securing a skier's foot inside said shell and at least temporarily connectable to said traction means, said quarter being adapted for oscillation with respect to said shell, said traction means being activated by said oscillation of said quarter with respect to said shell and having at least one locking element, said locking element being adapted for effecting operative uncoupling of said traction means from said oscillation of said quarter with respect to said shell, said foot securing device further comprising means for releasably locking said tension element to said shell.

8. A combination according to claim 7, wherein said device further comprises at least one fixed point, at least one first hole and at least one rear tab, said fixed point being located at said lateral internal surface of said shell, said presser being arranged at said inside of said shell, said first hole being formed laterally on said shell, said tab being defined rearwardly by said shell, said tension element being attached to said fixed point, extending substantially transversely above said presser, protruding from said shell at said first hole, and rearwardly engaging said tab, said tension element having a toothed strip, said toothed strip being located externally of said shell, and slidably positioned on said front portion thereof.

9. Combination according to claim 7, wherein said means for releasably locking said tensioning element to said shell comprise at least one block, at least one locking lever having a middle portion and at least one locking end, at least one locking abutment protrusion, and locking teeth, said block being fixed to said front portion of said shell, said middle portion of said locking lever being pivotally connected to said block, said locking teeth and said at least one locking abutment protrusion being defined at said locking end of said locking lever, said locking teeth having a saw-like teeth configuration, said locking abutment protrusion being directed towards said front portion of said shell.

10. A combination according to claim 9, wherein said means for releasably locking said tensioning element to said shell comprise elastic biasing means, said elastic biasing means being adapted for biasing said locking end of said locking lever into engagement with said toothed strip.

11. Combination according to claim 7, wherein said boot defines a rear part, wherein said tension element defines first abutment protrusions, and wherein said traction means comprise, at least one base, saw-like teeth having at least one second abutment protrusion, elastic means, and at least one lever having a middle portion and at least one engagement end, said lever being pivotally coupled at said middle portion thereof to said base, said base being fixed to said at least one quarter, said saw-like teeth being provided at said engagement end of said lever, said second abutment protrusion of said saw-like teeth being directed towards said front portion of said shell and opposed to at leat one of said first abutment protrusions of said tension element, said first abutment protrusions of said tension element being directed towards said rear part of said boot, said elastic means being adapted for causing said saw-like teeth of said engagement end of said lever to engage with said at least one toothed strip.

12. A combination according to claim 11, wherein said locking element comprises at least one operating tab, said operating tab being defined by said lever, said lever having an opposite side with respect to said engagement end, said operating tab being defined at said opposite side of said lever with respect to said engagement end, said at least one quarter having defined thereon at least one locking protrusion, said locking element being operable for uncoupling said traction means from said oscillation of said at least one quarter with respect to said shell, said operating tab being engageable with said locking protrusion defined on said at least one quarter.

13. Combination according to claim 11, wherein said locking element comprises at least one elastically pushed ball, and wherein said base has formed thereon a plurality of recesses, said at least one elastically pushed ball being at least partially laterally accommodated in said lever, said elastically pushed ball being at least partially insertable in at least one of said recesses, said locking element being operable for uncoupling said traction means from said oscillation of said at least one quarter with respect to said shell.

14. Combination according to claim 11, wherein said base fixed to said at least one quarter and said lever pivotally coupled at said middle portion thereof to said base define in combination, at least one sliding zone of said tension element.

15. In combination, a ski boot and a foot securing device, said ski boot comprising at least one quarter and a shell, said device comprising at least one tension element, traction means, and at least one presser, said quarter being pivotally associated with said shell, said tension element being adapted for actuating said at least one presser for securing a skier's foot inside said shell, said traction means being adapted for actuating said tension element, said quarter being adapted for oscillation with respect to said shell, said traction means being activated by said oscillation of said quarter with respect to said shell and having at least one locking element, said locking element being adapted for effecting operative uncoupling of said traction means from said oscillation of said quarter with respect to said shell, said foot securing device further comprising means for releasably locking said tension element to said shell, said means for releasably locking said tension element to said shell being actuable for locking said presser and said tension element in position upon uncoupling said traction means from said shell.

16. A combination according to claim 15, wherein said device further comprises at least one fixed point, at least one first hole and at least one rear tab, said fixed point being located at said lateral internal surface of said shell, said presser being arranged at said inside of said shell, said first hole being formed laterally on said shell, said tab being defined rearwardly by said shell, said tension element being atached to said fixed point, extending substantially transversely above said presser, protruding from said shell at said first hole, and rearwardly engaging said tab, said tension element having a toothed strip, said toothed strip being located externally of said shell, and slidably positioned on said front portion thereof.

17. Combination according to claim 15, wherein said means for releasably locking said tensioning element to said shell comprise at least one block, at least one locking lever having a middle portion and at least one locking end, at least one locking abutment protrusion, and locking teeth, said block being fixed to said front portion of said shell, said middle portion of said locking lever being pivotally connected to said block, said locking teeth and said at least one locking abutment protrusion being defined at said locking end of said locking lever, said locking teeth having a saw-like teeth configuration, said locking abutment protrusion being directed towards said front portion of said shell.

18. A combination according to claim 17, wherein said means for releasably locking said tensioning element to said shell comprise elastic biasing means, said elastic biasing means being adapted for biasing said locking end of said locking lever into engagement with said tensioning element.

19. Combination according to claim 15, wherein said boot defines a rear part, wherein said tension element defines first abutment protrusions, and wherein said traction means comprise, at least one base, saw-like teeth having at least one second abutment protrusion, elastic means, and at least one lever having a middle portion and at least one enagagement end, said lever being pivotally coupled at said middle portion thereof to said base, said base being fixed to said at least one quarter, said saw-like teeth being provided at said engagement end of said lever, said second abutment protrusion of said saw-like teeth being directed towards said front portion of said shell and opposed to at least one of said first abutment protrusions of said tension element, said first abutment protrusions of said tension element being directed towards said rear part of said boot, said elastic means being adapted for causing said saw-like teeth of said engagement end of said lever to engage with said at least one toothed strip.

20. A combination according to claim 19, wherein said locking element comprises at least one operating tab, said operating tab being defined by said lever, said lever having an opposite side with respect to said engagement end, said operating tab being defined at said opposite side of said lever with respect to said engagement end, said at least one quarter having defined thereon at least one locking protrusion, said locking element being operable for uncoupling said traction means from said oscillation of said at least one quarter with respect to said shell, said operating tab being engageable with said locking protrusion defined on said at least one quarter.

21. Combination according to claim 19, wherein said locking element comprises at least one elastically pushed ball, and wherein said base has formed thereon a plurality of recesses, said at least one elastically pushed ball being at least partially laterally accommodated in said lever, said elastically pushed ball being at least partially insertable in at least one of said recesses, said locking element being operable for uncoupling said traction means from said oscillation of said at least one quarter with respect to said shell.

22. Combination according to claim 19, wherein said base fixed to said at least one quarter and said lever pivotally coupled at said middle portion thereof to said base define in combination, at least one sliding zone of said tension element.

* * * * *